US009132985B2

(12) United States Patent
Wortmann et al.

(10) Patent No.: US 9,132,985 B2
(45) Date of Patent: Sep. 15, 2015

(54) CONVEYING DEVICE FOR LEADS

(71) Applicant: SCHLEUNIGER HOLDING AG, Thun (CH)

(72) Inventors: Thomas Wortmann, Remscheid (DE); Peter Schuetz, Solingen (DE)

(73) Assignee: SCHLEUNIGER HOLDING AG, Thun (CH)

( * ) Notice: Subject to any disclaimer, the term of this patent is extended or adjusted under 35 U.S.C. 154(b) by 0 days.

(21) Appl. No.: 14/357,222

(22) PCT Filed: Nov. 9, 2012

(86) PCT No.: PCT/IB2012/056303

§ 371 (c)(1),
(2) Date: May 12, 2014

(87) PCT Pub. No.: WO2013/068984

PCT Pub. Date: May 16, 2013

(65) Prior Publication Data

US 2014/0284368 A1 Sep. 25, 2014

(30) Foreign Application Priority Data

Nov. 11, 2011 (CH) ..... 01809/11

(51) Int. Cl.
*H01B 13/00* (2006.01)
*B65H 54/02* (2006.01)
(Continued)

(52) U.S. Cl.
CPC ..... *B65H 51/18* (2013.01); *H01B 13/0003* (2013.01); *H01B 13/0207* (2013.01)

(58) Field of Classification Search
CPC ..... H01B 13/003
USPC ..... 198/468.2, 468.9, 470.1, 474.1; 294/192, 198; 226/173
See application file for complete search history.

(56) References Cited

U.S. PATENT DOCUMENTS 831,729 A 9/1906 Merry
3,198,220 A 8/1965 Scamberti
(Continued)

FOREIGN PATENT DOCUMENTS

CH 673858 A5 4/1990
DE 3630359 A1 3/1988
(Continued)

OTHER PUBLICATIONS

Full English Translation of International Search Report and written opinion, dated Mar. 6, 2013, from parent International appln. PCT/IB2012/056303 published as WO2013/068984A1 on May 16, 2013.
(Continued)

*Primary Examiner* — Douglas Hess
(74) *Attorney, Agent, or Firm* — George Kapsalas; Patentbuero Paul Rosenich AG

(57) ABSTRACT

The invention relates to a conveying device for conveying electrical or optical lines (8) such as wires, cables, line bundles, optical fibers etc. comprising a gripper (3) for gripping a line (8), wherein the gripper (3) is displaceable along a guide (1) between a first position (5) and a second position (6), characterized in that in the region of the first position (5) and in the region of the second position (6), respectively one active interface is provided which is configured to come into operative communication with the gripper (3) and bring this into a closed position or open position when the gripper (3) is located in one of the two positions (5, 6).

20 Claims, 4 Drawing Sheets

(51) Int. Cl.
*B65H 51/18* (2006.01)
*H01B 13/02* (2006.01)

(56) References Cited

U.S. PATENT DOCUMENTS

| | | | | |
|---|---|---|---|---|
| 3,540,110 | A | 11/1970 | Schwarz | |
| 3,839,777 | A | 10/1974 | Puzio | |
| 4,095,497 | A | 6/1978 | Radford et al. | |
| 4,272,951 | A | 6/1981 | Vogelsberg | |
| 4,506,566 | A | 3/1985 | Schmid | |
| 4,655,107 | A | 4/1987 | Juergenhake | |
| 4,699,414 | A * | 10/1987 | Jones | 294/119.1 |
| 4,800,791 | A | 1/1989 | Jürgenhake | |
| 5,033,785 | A * | 7/1991 | Woolley, Jr. | 294/104 |
| 5,247,732 | A | 9/1993 | Lait et al. | |
| 5,253,912 | A * | 10/1993 | Andorlini et al. | 294/119.1 |
| 5,282,717 | A | 2/1994 | Löhr et al. | |
| 5,350,101 | A | 9/1994 | Godlewski | |
| 5,412,855 | A | 5/1995 | Koch | |
| 5,650,181 | A | 7/1997 | Kotaki | |
| 5,816,384 | A | 10/1998 | Hsu | |
| 5,820,008 | A | 10/1998 | College | |
| 5,960,622 | A | 10/1999 | Koch et al. | |
| 6,135,164 | A | 10/2000 | Celoudoux et al. | |
| 6,167,919 | B1 | 1/2001 | Füchsl et al. | |
| 6,289,944 | B1 | 9/2001 | Frommenwiler | |
| 6,435,336 | B1 * | 8/2002 | Knodler | 198/474.1 |
| 6,490,785 | B1 | 12/2002 | Kometani | |
| 6,702,099 | B2 * | 3/2004 | Otaguro et al. | 198/468.6 |
| 6,948,675 | B2 | 9/2005 | Frommenwiler | |
| 6,999,847 | B2 * | 2/2006 | Barry et al. | 700/213 |
| 7,021,510 | B2 * | 4/2006 | Ellingson | 226/172 |
| 7,043,825 | B2 * | 5/2006 | Conte | 29/748 |
| 7,178,708 | B2 * | 2/2007 | Grinsted | 226/172 |
| 7,647,759 | B2 | 1/2010 | Braun et al. | |
| 8,113,557 | B2 * | 2/2012 | Kirst et al. | 294/106 |
| 8,646,822 | B2 * | 2/2014 | Braun et al. | 294/207 |
| 2005/0050713 | A1 | 3/2005 | Locher et al. | |
| 2011/0049211 | A1 | 3/2011 | Schütz et al. | |

FOREIGN PATENT DOCUMENTS

| | | | |
|---|---|---|---|
| DE | 4104597 | A1 | 10/1991 |
| DE | 19624973 | A1 | 1/1998 |
| DE | 19631770 | A1 | 2/1998 |
| DE | 19844416 | A1 | 4/1999 |
| DE | 10107670 | A1 | 9/2002 |
| DE | 102010017981 | A1 | 10/2010 |
| EP | 0303724 | A1 | 2/1989 |
| EP | 0598276 | A1 | 5/1994 |
| EP | 0708050 | A1 | 4/1996 |
| EP | 0788200 | A2 | 8/1997 |
| EP | 0984530 | A1 | 3/2000 |
| EP | 1009074 | A2 | 6/2000 |
| EP | 1032095 | A2 | 8/2000 |
| EP | 1213800 | A1 | 6/2002 |
| EP | 1387449 | A1 | 2/2004 |
| EP | 0889486 | B1 | 8/2004 |
| EP | 1447888 | A1 | 8/2004 |
| EP | 1691457 | A1 | 8/2006 |
| EP | 1032095 | A3 | 5/2008 |
| GB | 868532 | A | 5/1961 |
| JP | 2004-071237 | A | 3/2004 |
| WO | 93/06320 | A1 | 4/1993 |
| WO | 2009/141794 | A2 | 11/2009 |
| WO | 2011/055336 | A1 | 5/2011 |
| WO | 2013/068981 | A1 | 5/2013 |
| WO | 2013/068986 | A1 | 5/2013 |
| WO | 2013/068988 | A1 | 5/2013 |
| WO | 2013/068990 | A1 | 5/2013 |
| WO | 2013/068998 | A1 | 5/2013 |

OTHER PUBLICATIONS

International Search Report and written opinion, dated Mar. 6, 2013, from parent International appln. PCT/IB2012/056303 published as WO2013/068984A1 on May 16, 2013, with partial English transl.

Copending commonly-owned U.S. Appl. No. 14/273,020, filed May 8, 2014.

Copending commonly-owned U.S. Appl. No. 14/357,226 entered U.S. national phase May 11, 2014.

Copending commonly-owned U.S. Appl. No. 14/357,248 entered U.S. national phase May 11, 2014.

Copending commonly-owned U.S. Appl. No. 14/357,264 entered U.S. national phase May 11, 2014.

* cited by examiner

CONVEYING DEVICE FOR LEADS

This application is a 35 U.S.C. 371 national-phase entry of PCT International application no. PCT/IB2012/056303 filed on Nov. 9, 2012 and also claims benefit of priority to prior Swiss national application no. CH-01809/11 filed on Nov. 11, 2011, and parent PCT International application no. PCT/IB2012/056303 is expressly incorporated herein by reference, in its entirety, for all intents and purposes, as if identically set forth in full herein.

The invention relates to a conveying device and a method for conveying electrical or optical lines such as wires, cables, line bundles, optical fibres, etc. A gripper for gripping a line is displaceable along a guide between a first position and a second position.

DE4104597A1 discloses a rewind device having a rotating gripper which is displaceable along an inclined guide rail between two end positions. End position switches are provided at the end positions. When the gripper reaches an end position switch, it is opened. The end position switches merely serve to generate a trigger signal. In addition, this rewind device is unsuitable for conveying lines.

In conveying devices with a displaceable gripper, pneumatically actuated grippers are used in the prior art. Here, the power supply is accomplished permanently via a drag chain. That is, the gripper is displaceable together with its drive, and is continuously connected to a power supply.

The disadvantages of such a conveying device are that the co-moved drag chain constitutes an additional mass that requires an additional drive requirement, and, as a result, necessitates a correspondingly larger dimensioning of the entire drive train.

Furthermore, as a result of the high clock frequency of the system, a rapid wear of the drag chain and ensuing down times may be expected. Additional installation space needs to be provided for the drag chain, making the machine correspondingly more voluminous.

It is the object of the invention to eliminate these problems and provide a conveying device that grips a finished line end and moves it as rapidly as possible from a receiving site to a dispensing site. This dispensing site may be less than 1 m, a few meters or even more than 10 m away from the receiving site. Regardless of this, a high movement dynamics should be achieved with, at the same time, low machine building expenditure.

The invention achieves this object with a conveying device of the type mentioned initially, whereby in the region of the first position and in the region of the second position, respectively, one active interface is provided that is configured to come into operative communication with the gripper and bring this into a closed position or open position when the gripper is located in one of the two positions.

Through the provision of external active interfaces that only come into operative communication with the gripper when the gripper is located in the region of the respective end position, the design can be accomplished in a simple and space-saving manner. In other words, the range of action of an external active interface is restricted to the region around the first or second position.

Active interface is understood as a means acting actively on the gripper, for example, an external mechanical gripper drive or an external power supply device for the gripper drive (when this is configured to be displaceable together with the gripper), where the gripper drive is to be understood as that drive that effects the opening or closing movement of the gripper. The active interface acts locally, that is, in the region of the first or second position.

The conveying includes the active pulling of the line through the gripper. Preferably, the line is therefore pulled lengthwise, that is substantially along the direction which is given by the longitudinal extension of the line.

The gripper in this case grips (as a result of external actuation) the line end, and preferably moves it as fast as possible, preferably linearly, from the first position to the second position. The gripper may in this case be designed without a continuously co-moving drag chain (i.e., cable carrier chain), and with low mass, so that a high movement dynamics is achieved. In particular, a permanent power supply of the gripper (e.g. via a drag chain) can also be dispensed with, while the actuation of the displaceable gripper is accomplished by external mechanical actuating devices or external power supply that are each located at the first position and at the second position.

The low moving mass of the gripper allows a smaller, highly dynamic drive. The clock frequency may be increased compared with the drag chain solution from the prior art. The machine can be designed more compactly since no additional installation space needs to be provided for the drag chain. All these advantages are accompanied by a considerable cost saving.

In one version, the active interfaces each include an active mechanical actuating device, as drive for the gripper, that is configured to mechanically actuate the gripper. A reliable closing or opening movement, independent of the movement of the gripper along the guide, is thereby accomplished. The closing and opening of the gripper may be matched (to other processes) and controlled in a temporally exact manner.

In one version, at least one active interface comprises a cylinder-piston unit, preferably a pneumatic cylinder, in order to bring the gripper into a closed position or open position, and wherein the supply pressure for the cylinder-piston unit is variably adjustable by a controller.

This measure is used to optimise the actuating force of the active interface, in particular the gripper closer. This enables the supply (air) pressure to be adjusted per program and thereby also makes the closing force of the gripper jaws of the gripper adjustable per program. As a result of this adjustable closing force, thin and sensitive lines may be gripped gently. The application of force is preferably achieved by a pneumatic cylinder.

In one version, the conveying device includes a gripper drive for the gripper. This drive is displaceable together with the gripper along the guide, and the active interfaces are configured as power supply in order to supply power to the gripper drive. In this case, the gripper drive is displaceable with the gripper (i.e., configured to be integrated with this) but the power supply is accomplished via external active interfaces. The gripper drive is therefore only supplied with power in the end positions. During its movement from one position to the other, it is cut off from the power supply.

In one version, the active interface is an electrical contact and/or a compressed air coupling. Such means provide an external power supply for the gripper drive, which external power supply is particularly easy to achieve.

In one version, the gripper includes a bistable mechanism, wherein a dead point is provided between the stable open position and the stable closed position. This ensures that the position of the gripper is defined and stable in each operating state. The gripper is only actuated via the active interfaces in the end positions. These guide the gripper from one stable position, via a dead point, into another stable position.

In one version, the gripper is held closed by a spring force at least in the closed state. This increases the gripping force and reliably secures the gripped line end during the displacement along the guide.

In one version, the first position is a receiving station for receiving the line, and the second position is a dispensing station for dispensing the line. Such a device is suitable for the intermittent drawing of lines of certain length into a processing machine.

In one version, the active interfaces are stationary in relation to the guide. This allows a simple and reliable design.

In one version, the gripper is formed from at least two gripper jaws which are movable with respect to one another.

In one version, in the region of the first position and/or in the region of the second position, a transfer or receiving gripper is provided that transfers the line to the gripper or receives it from this. The transfer or receiving gripper may thereby place the line end precisely according to the process steps.

In one version, the conveying device is a drawing-in gripper unit for a line processing apparatus, in particular for a cable twister. Since the conveying device is also suitable for large distances, correspondingly long lines, in particular cable, can be pulled into a cable twister where they are then fixed and twisted in a twisting head.

In one version, at least one active interface is displaceable relative to the guide along a direction that is substantially parallel to the direction of displacement of the gripper along the guide. For positioning of the active interface relative to the guide, the gripper is coupled directly or indirectly to the active interface, so that during a displacement of the gripper along the guide, the active interface is driven relative to the guide by the gripper and is brought into the desired position.

In one version, the conveying device has a base that includes at least two parts, wherein a second part of the base is displaceable relative to a first part of the base along a direction that is substantially parallel to the displacement direction of the gripper along the guide, and wherein the guide with the gripper sits on the first part of the base and an active interface sits on the second part of the base. For displacement of the second part of the base relative to the first part of the base the gripper may be coupled to the second part of the base, preferably via the active interface, so that during a displacement along the guide the gripper drives the second part of the base relative to the first part of the base.

As a result of this measure, the distance between the active interfaces, or between receiving site and dispensing site, may be varied simply, e.g., in order to adapt the conveying device to the length of the lines to be processed. One of the active interfaces is thus displaced into its desired position in a programmable manner by the gripper. A complete positioning axis can be saved by this coupling-on function. The positioning is taken over by the gripper whose control is already provided in any case.

The invention also relates to a method for conveying electrical or optical lines such as wires, cables, line bundles, optical fibres etc. between a first position and a second position, comprising a gripper for gripping a line, wherein the gripper together with the line is displaced along a guide between the first position and the second position, wherein in the region of the first position an active interface is provided which brings the gripper into a closed position which thereby grips the line and that in the region of the second position, an active interface is provided which brings the gripper displaced into the second position and thus_into an open position which thereby releases the line.

In one version, the active interfaces each include a mechanical actuating device as drive for the gripper which mechanically actuate the gripper.

In one version, at least one active interface is displaceable relative to the guide along a direction that is substantially parallel to the direction of displacement of the gripper along the guide. For positioning of the active interface relative to the guide, the gripper is coupled directly or indirectly to the active interface, and the coupled gripper is displaced along the guide so that the active interface is driven relative to the guide by the gripper and is brought into the desired position.

Without needing to introduce its own positioning axis, the conveying device may thereby be adapted to the length of the lines to be conveyed or processed.

Further versions of the invention are given in the figures and in the dependent patent claims. The reference list is part of the disclosure.

Figure 1:
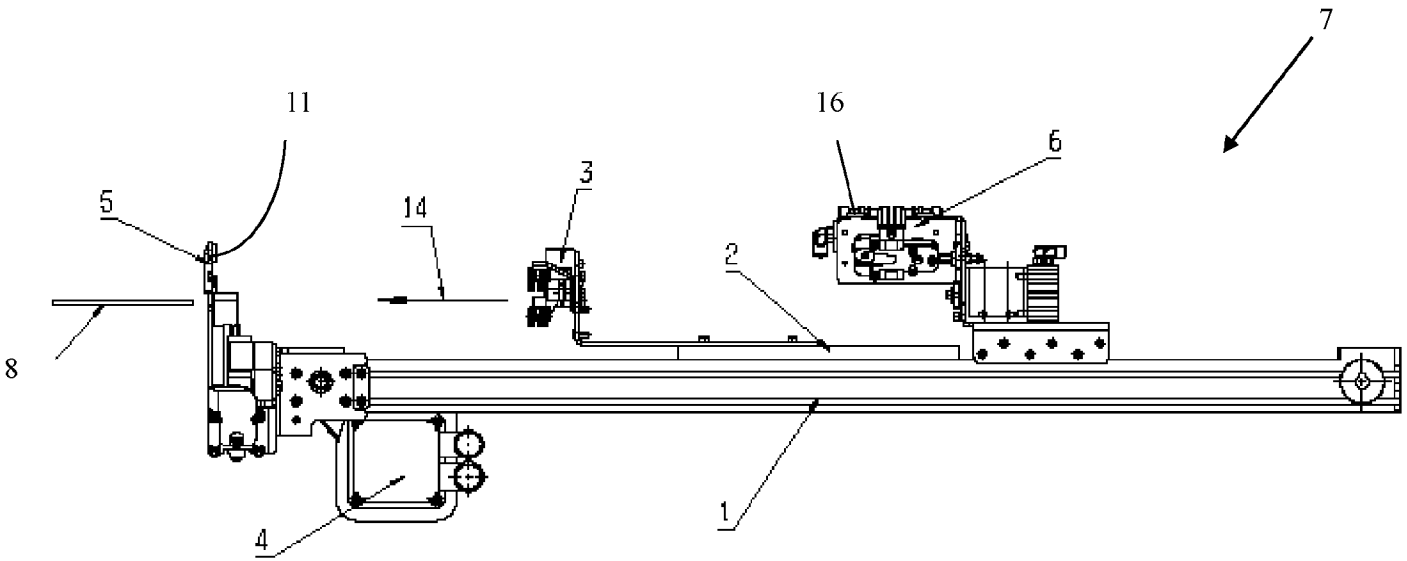
FIG. 1 depicts a conveying device according to the invention.

FIG. 1 shows a conveying device 7 for a line 8 including a linear guide 1 on which a carriage 2 is displaceable between two positions 5 and 6. A gripper 3 is fastened to the carriage 2. The gripper 3 can adopt opened and closed (gripping) positions. The direction of movement 14 of the gripper 3 along the linear guide 1 to the receiving station (corresponds to the first position 5) is indicated by an arrow in FIG. 1. In the version shown, the carriage drive 4 is disposed on the underside of the guide 1 and can, for example, cooperate with a continuous cable, a belt or band drive with the carriage 2.

Such a conveying device 7 may be a pulling-in gripper unit for pulling in the line 8 into a line processing apparatus, in particular into a cable twister.

A gripper 3 including two gripper jaws 15 is fastened to the carriage 2. The gripper 3 has a mechanism that enables a bistable fixing of the gripper jaws 15. That is, the gripper 3 is either open or closed. In the closed state a defined force is applied to the gripper jaws 15. In a preferred version, the force is applied by a pre-tensioned spring that acts on the gripper jaws 15 via gripper levers.

An active interface is respectively provided at the first position 5 and at the second position 6. This is configured to come into operative communication with the gripper 3 and to respectively bring this gripper 3 actively into a closed position or open position when the gripper 3 is located in a respective one of the two positions 5, 6. In the exemplary version shown, the active interfaces each include a mechanical actuating device, the gripper closer 11 and the gripper opener 16. These form a drive for the gripper 3 and respectively bring the gripper 3 either into the open or closed position. The active interfaces are stationary in relation to the guide 1, therefore do not move with gripper 3 when it is displaced from one position 5 to the other position 6. It would fundamentally also be feasible to leave the active interfaces movable to a limited extent, in each case, within a small region about a respective position 5,6 in order to achieve a certain overall flexibility of the conveying device 7. In each case, it is however the case that the gripper 3 only comes into the active region of the respective active interface 5,6 by displacement in the region of one of the positions 5,6, or, in other words: the active region of the active interfaces is locally limited in the region of the positions 5, 6.

Figure 2A:
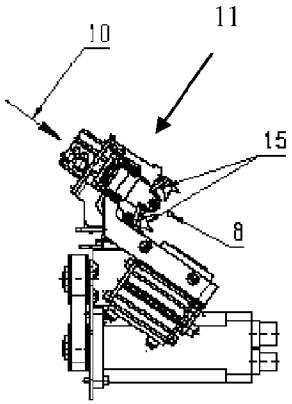
FIG. 2*a* depicts the gripper transverse to the guide in the receiving station.

FIG. 2*a* shows the gripper 3 in the receiving station with gripper jaws 15 still open. Through the closing movement 10 of the gripper closer 11—this presses with one part (e.g. a pneumatically actuated bolt) against an active surface of the gripper 3—the gripper jaws 15 are brought into the closed position via gripper levers.

Figure 3A:
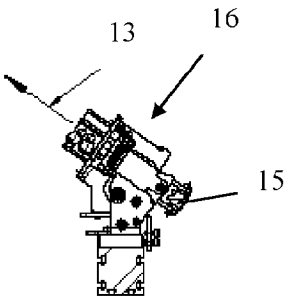
FIG. 3*a* depicts the gripper transverse to the guide in the dispensing station.

FIG. 3*a* shows the gripper 3 in the dispensing station with gripper jaws 15 still closed and gripping the line 8. Through the opening movement 13 of the gripper opener 16—this pulls an active surface of the gripper 3 with one part—the gripper jaws 15 are brought into the open position via gripper levers.

Gripper closer 11 and gripper opener 16 are external active drives for the displaceable gripper 3. They act directly on the gripper 3 and thereby effect the closing or opening movement.

Figure 2:
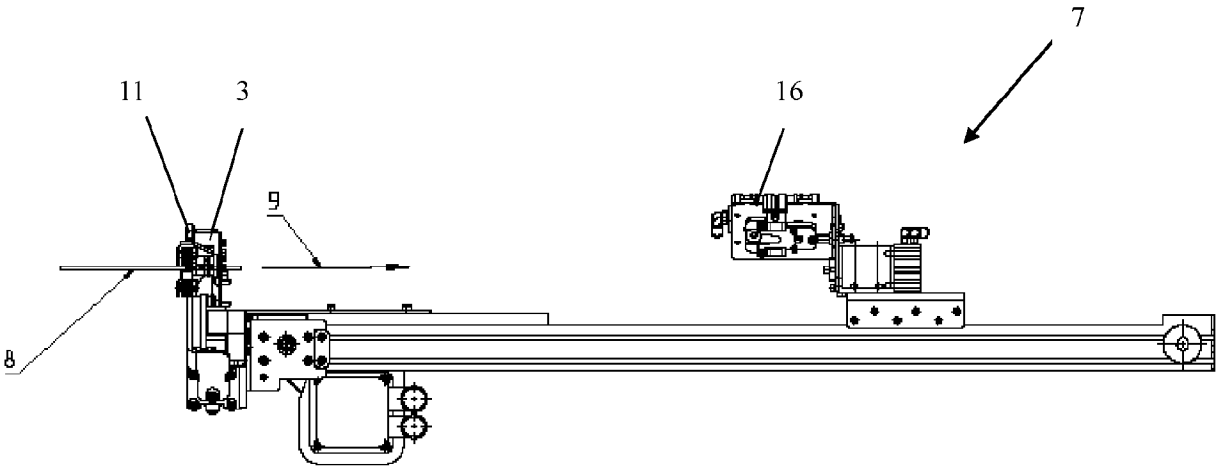
FIG. 2 depicts a conveying device according to FIG. 1 in the receiving position.
Figure 3:
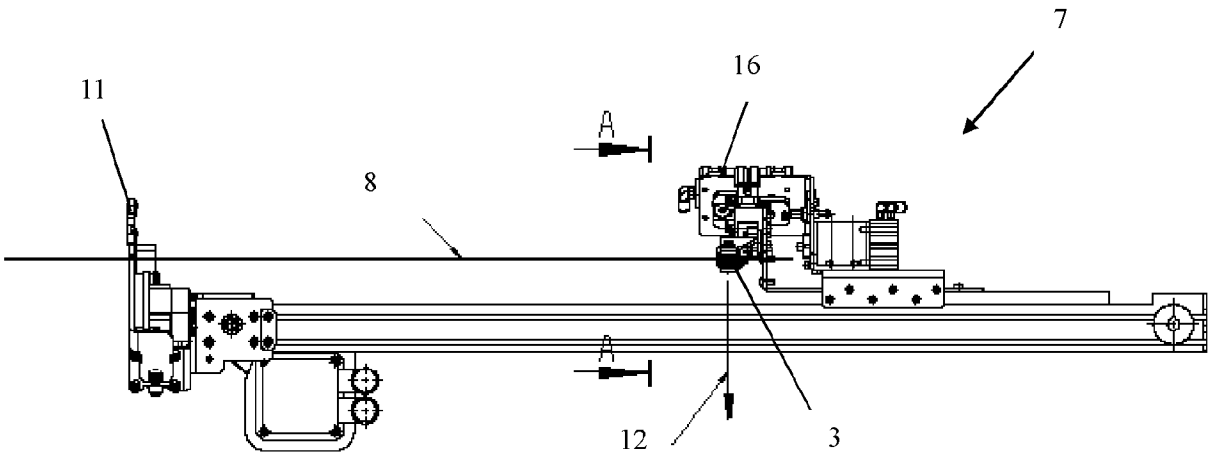
FIG. 3 depicts the conveying device according to FIG. 1 in the dispensing position.

FIGS. 2 and 3 depict the conveying device 7 in various operating states. For receiving the line 8, the gripper 3 travels into the first position 5 which constitutes a receiving station for receiving the line 8. There, the line 8 to be transported is guided between the open gripper jaws 15. This is accomplished, for example, by a transfer gripper which guides the line end into the gripping region of the gripper 3. The gripper jaws 15 are closed by the fixed active interface configured as gripper closer 11, which presses from outside via a mechanical transmission mechanism onto the gripper jaws 15. The gripper 3 then travels in conveying direction 9 into the second position 6, the dispensing station for dispensing the line 8 (FIG. 3). The active interface at the second position 6 is configured as gripper opener 16. Here the line 8 is gripped by another handling mechanism (e.g. receiving gripper) and the gripper opener 16 then opens the gripper 3 against the spring pre-tension of the gripper jaws 15.

Since the gripper 3 has a bistable mechanism, it then remains open even without external actuation. The further handling mechanism then removes the line end from the dispensing station (second position 6). In the version depicted, the line 8 is dispensed downwards in the direction of dispensing movement 12.

The open gripper 3 then travels further into the first position 5, the receiving station, and there retrieves a new line 8. The lines 8 are conveyed lengthwise, i.e. substantially in the direction of their longitudinal extension.

In the exemplary version shown, the gripper 3 is actuated by external, pneumatically driven actuating devices 11, 16. An actuation by electrical drives and/or hydraulic conversion is also conceivable. In these cases, the active interfaces take over the function of the drive for the gripper 3. The drive or drives are therefore not displaced jointly with the gripper 3 along the guide 1. Each position 5,6 has its own respective drive with which the gripper 3 comes into operative communication in the respective position 5,6.

Alternatively to this, the drive for opening and closing could be attached to the gripper 3, or to the displaceable carriage 2 itself. The supply with power (e.g., current or compressed air) would be accomplished exclusively in the end positions 5 and 6, i.e. in the receiving and the dispensing stations. The coupling is accomplished in this case, e.g. in the electrical case via electrical contacts, in the pneumatic case via pneumatic compressed air couplings with which the gripper 3 or the carriage 2 comes into overlap (contact, coupling).

Figure 4:
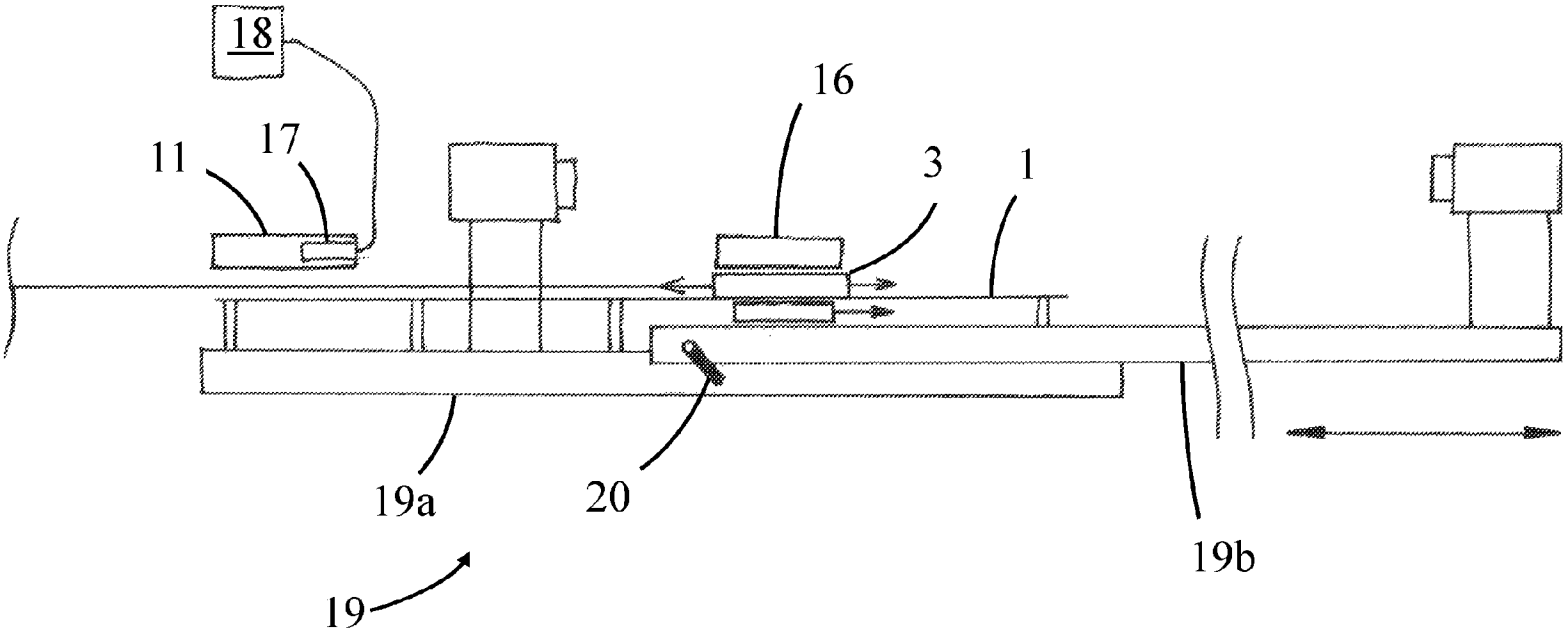
FIG. 4 depicts one version of a conveying device.

FIG. 4 is a schematic view that is simplified compared with FIG. 1, and depicts a preferred version in which at least one active interface 16 is displaceable relative to the guide 1 along a direction that is substantially parallel to the direction of travel of the gripper 3 along the guide 1.

For positioning of an active interface, in the present case being the gripper opener 16, relative to the guide 1, the gripper 3 may be coupled directly or indirectly to the active interface. In the present example, the active interface 16 couples directly to the gripper 3 which has moved previously into this position. The coupled gripper 3 is now moved along the guide 1 so that the active interface 16 is driven relative to the guide 1 by the gripper 3 and is brought into the desired position. Naturally, it would also be possible to make the gripper closer 11 displaceable by the gripper 3 instead of or in addition to the gripper opener 16.

In the exemplary version depicted, the above measures are implemented by the conveying device 7 having a base 19 that includes at least two parts 19*a*, 19*b*, where a second part 19*b* of the base 19 is displaceable relative to a first part 19*a* of the base 19 along a direction substantially parallel to the direction of displacement of the gripper 3 along the guide 1. The guide 1 with the gripper 3 sits on the first part 19*a* of the base 19 and the displaceable active interface, in the present case the gripper opener 16, sits on the second part 19*b* of the base 19. For positioning of the second part 19*b* of the base 19 relative to the first part 19*a* of the base 19, the gripper 3 can be coupled to the second part 19*b* of the base 19, preferably directly via the active interface 16, as shown in FIG. 4, so that the gripper 3 during a displacement along the guide 1 drives the second part 19*b* of the base 19 relative to the first part 19*a* of the base 19 and brings it into the desired position. The gripper 3 is then uncoupled again. A brake 20 is provided to lock the second part 19*b* of the base in the desired position.

In other words: for setting up the machine to the desired line length, the displaceable part 19*b* must be re-positioned. To accomplish this, the gripper 3 initially travels without line to the corresponding active interface. The coupling takes place in this position. The brake 20 of the displaceable part 19*b* is then released. The (indirect) coupling of the gripper 3 to the second part 19*b* now enables second part 19*b* to be displaced into the new position with the aid of the linear axis of the gripper 3. There, the brake 20 of the second part 19*b* is again fixed, and the gripper 3 is uncoupled. The conveying device 7 with the gripper 3 is now ready to draw in new lines to be twisted.

Preferably the first part 19*a* of the base 19 is a stationary part, e.g. a substructure mounted fixedly to the frame (in FIG. 4 left) and the second part 19*b* is a part that is displaceable in the longitudinal direction e.g. a wagon or carriage by which the distance between the active interfaces may be varied, and that is positioned and fixed according to the line length to be processed. The direction of travel is indicated by a double arrow in FIG. 4. The displaceable part 19*b* of the base 19 may be fixed on the stationary part of the base 19 by a brake 20, i.e., may be locked in the desired position.

In the example of FIG. 4 the second part 19*b* of the base is mounted directly on the first part 19*a* of the base. Alternatively the second part 19*b* of the base could also be mounted on the guide 1 and be displaceable along the guide 1 and lockable. The expressions 'first and second part of the base' are therefore to be understood in the broadest sense.

As can be understood from FIG. 4, preferably at least one active interface comprises a cylinder-piston unit 17, preferably a pneumatic cylinder in order to bring the gripper 3 into a closed position or open position, where the supply pressure for the cylinder-piston unit 17 is variably adjustable by a control 18.

The disclosure of the following commonly owned applications: published PCT application no. WO 2013/068981A1 published May 16, 2013; published PCT application no. WO 2013/068986A1 published May 16, 2013 and nationalized in the U.S. as U.S. application Ser. No. 14/357,226; published PCT application no. WO 2013/0689881 published May 16, 2013 and nationalized in the U.S. as U.S. application Ser. No. 14/357,248; and, published PCT application no. WO 2013/068990A1 published May 16, 2013 and nationalized in the U.S. as U.S. application Ser. No. 14/357,264; (Internal file references of the Common Applicant respectively being: S124PWO, S126PWO, S127PWO, S141PWO), which were all filed at the International Bureau on Nov. 9, 2012, form an integral component of the present application and should be seen in combination with the same, since these separate applications each relate to different aspects of the same machine. Further synergistic effects result from this.

LIST OF REFERENCE LABELS

1—Guide
2—Carriage
3—Gripper
4—Carriage drive
5—First position (with gripper closer)
6—Second position (with gripper)
7—Conveying device
8—Line
9—Conveying direction
10—Closing movement of gripper closer
11—Gripper closer
12—Direction of dispensing movement of line end
13—Opening movement of gripper opener
14—Direction of movement of gripper to receiving station
15—Gripper jaws
16—Gripper opener
17—Cylinder-piston unit
18—Control
19—Base
19*a*—First part of base 19
19*b*—Second part of base 19
20—Brake

What is claimed is:

1. A line conveying machine comprising:

a gripper;

a carriage, said gripper being mounted on said carriage;

a guide, said carriage being displaceable on said guide along a first path between a first position and second position;

a carriage drive operatively connected to said carriage to controllably displace said carriage with said gripper along said first path;

an actuating mechanism configured to actuate said gripper, said actuating mechanism being mounted on said carriage to travel between said first and second positions;

a first active interface situated proximate to said first position, said first active interface communicating motive energy to said gripper in a region of said first position to bring said gripper into closed position;

a second active interface situated proximate to said second position, said second active interface communicating motive energy to said gripper in a region of said second position to bring said gripper into open position;

a base, said base having a first part, said base having a second part, said second part being controllably displaceable relative to said first part along a second path substantially parallel to said first path;

said guide, said carriage, said first active interface, and said gripper being situated on said first part of said base; and, said second active interface being situated on said second part of said base so that said gripper controllably drives said second part of said base relative to said first part of said base via said second active interface.

2. A line conveying machine as claimed in claim 1, further comprising:

a selectively releasable brake locking said second part against displacement relative to said first part.

3. The line conveying machine as claimed in claim 1, wherein:

said second part is mounted on said guide.

4. A line conveying machine as claimed in claim 1, further comprising:

a receiving station receiving lines at said first position; and, a dispensing station dispensing lines at said second position.

5. A line conveying machine comprising:

a gripper;

a guide, said gripper being displaceable along said guide along a first path between a first position and a second position;

an actuating mechanism configured to actuate said gripper, said gripper and said actuating mechanism being operatively movably mounted on said guide to travel between said first and second positions;

a first active interface communicating motive energy to said gripper in a region of said first position to bring said gripper into closed position, said first active interface situated proximate to said first position; and, a second active interface communicating motive energy to said gripper in a region of said second position to bring said gripper into open position, said second active interface situated proximate to said second position.

6. A line conveying machine as claimed in claim 5, further comprising:

a mechanical actuator in said first active interface, said mechanical actuator driving said actuating mechanism and said gripper.

7. A line conveying machine as claimed in claim 5, further comprising:

a mechanical actuator in said second active interface, said mechanical actuator driving said actuating mechanism and said gripper.

8. A line conveying machine as claimed in claim 5, further comprising:

a fluid-powered cylinder-piston unit located in at least one of said first and second active interfaces, said cylinder-piston unit being in operative communication with a supply pressure controller.

9. A line conveying machine as claimed in claim 5, further comprising:

a gripper drive for said gripper, said gripper drive being displaceable together with said gripper along said guide; and, at least one of said first and second active interfaces includes power supply for said gripper drive.

10. The line conveying machine as claimed in claim 5, wherein:

said actuating mechanism is bistable, said actuating mechanism having stable open and closed positions, and a dead point is provided between said stable open and closed positions.

11. A line conveying machine as claimed in claim 5, further comprising:

a spring connected to exert force holding said gripper in closed state.

12. A line conveying machine as claimed in claim 5, further comprising:

a receiving station receiving lines at said first position; and, a dispensing station dispensing lines at said second position.

13. The line conveying machine as claimed in claim 5 wherein:

said first active interface and said second active interface are stationary in relation to said guide.

14. A line conveying machine as claimed in claim 5, further comprising:

a transfer gripper transferring line to said first gripper, said transfer gripper located proximate to said first position; and, a receiving gripper receiving line from said first gripper, said receiving gripper located proximate to said second position.

15. A line conveying machine as claimed in claim 5, further comprising:

a base, said base having a first part, said base having a second part, said second part being controllably displaceable relative to said first part along a second path substantially parallel to said first path;

said guide and said gripper being situated on said first part of said base; and, one of said first and second active interfaces being situated on said second part of said base, said gripper controllably driving said second part of said base relative to said first part of said base.

16. A method of conveying lines comprising the steps of:

positioning a gripper along a guide to reach a first position;

supplying motive energy to the gripper from a first active interface in a region of the first position;

using the supplied motive energy from the first active interface to grip a line with the gripper;

displacing the gripper and gripped line along the guide;

reaching a second position with the gripper and gripped line;

supplying motive energy to the gripper from a second active interface in a region of the second position; and, using the supplied motive energy from the second active interface to release the gripped line from the gripper.

17. A method of conveying lines as claimed in claim 16, further comprising the step of:

actuating the gripper mechanically to grip the line.

18. A method of conveying lines as claimed in claim 16, further comprising the step of:

actuating the gripper mechanically to release the line.

19. A method of conveying lines as claimed in claim 16, further comprising the steps of:

controllably displacing at least one of the first and second active interfaces relative to the guide along a direction substantially parallel to the direction of displacement of the gripper along the guide; and, effecting said step of controllably displacing at least one of the first and second active interfaces relative to the guide, by operatively coupling the gripper to drive at least one of the first and second active interfaces relative to the guide to attain a desired position.

20. A method of conveying lines as claimed in claim 19, further comprising the step of:

effecting said step of controllably displacing at least one of the first and second active interfaces relative to the guide, to vary the distance between the first and second active interfaces based on line length that is handled.

* * * * *